US008162689B2

(12) United States Patent
Brandberg et al.

(10) Patent No.: US 8,162,689 B2
(45) Date of Patent: Apr. 24, 2012

(54) CLAMPING DEVICE FOR CONNECTING A CONDUCTOR WITHOUT STRIPPING THE INSULATION

(75) Inventors: Eric Brandberg, Harrisburg, PA (US); Ralf Geske, Schieder-Schwalenberg (DE)

(73) Assignee: Phoenix Contact GmbH & Co., KG (DE)

( * ) Notice: Subject to any disclaimer, the term of this patent is extended or adjusted under 35 U.S.C. 154(b) by 646 days.

(21) Appl. No.: 12/065,188

(22) PCT Filed: Aug. 29, 2006

(86) PCT No.: PCT/EP2006/008495

§ 371 (c)(1),
(2), (4) Date: May 18, 2009

(87) PCT Pub. No.: WO2007/025745

PCT Pub. Date: Mar. 8, 2007

(65) Prior Publication Data

US 2012/0058666 A1 Mar. 8, 2012

Related U.S. Application Data

(60) Provisional application No. 60/712,210, filed on Aug. 29, 2005.

(30) Foreign Application Priority Data

Aug. 25, 2006 (EP) ..... PCT/EP2006/008327

(51) Int. Cl.
*H01R 11/20* (2006.01)

(52) U.S. Cl. ..... 439/410

(58) Field of Classification Search ..... 439/410, 439/409

See application file for complete search history.

(56) References Cited

U.S. PATENT DOCUMENTS

| | | | | |
|---|---|---|---|---|
| 4,448,473 | A * | 5/1984 | Felix et al. | 439/409 |
| 5,504,654 | A * | 4/1996 | Knox et al. | 361/119 |
| 6,048,223 | A * | 4/2000 | Bechaz et al. | 439/417 |
| 6,406,324 | B1 * | 6/2002 | Duesterhoeft et al. | 439/409 |

(Continued)

FOREIGN PATENT DOCUMENTS

GB 2129630 5/1984

(Continued)

OTHER PUBLICATIONS

International Search Report for PCT/EP2006/008495, Dec. 7, 2006, EPO.

(Continued)

*Primary Examiner* — Gary F. Paumen
(74) *Attorney, Agent, or Firm* — Bourque and Associates, PA

(57) ABSTRACT

Disclosed is a clamping device for connecting a conductor without stripping the insulation. Said clamping device comprises a housing (14) and an actuating part (22 which is movably mounted therein and is provided with a duct (26) accommodating the conductor (50) that is to be clamped. A blade contact (18.1) is provided which encompasses a rear web (32) and two spring legs (36) that are placed at an angle therefrom. The spring legs (36) are fitted with contacting blades (48) on final edges that run into each other. Said contacting blades (48) penetrate the duct (26) and contact the conductor (50) accommodated therein while cutting the insulation thereof when the actuating part (22) is transferred into the contacting position thereof. A second contact piece (18.2) is provided which is electrically connected to the blade contact (18.1). The blade contact (18.1) and the second contact piece (18.2) are configured as a monolithic contact element (18) as a result of the fact that spring arms (34) whose ends are formed into a contact tube or a tulip contact (40) are placed at an angle from the rear web (32) of the blade contact (18.1) in addition to the spring legs (36).

10 Claims, 5 Drawing Sheets

U.S. PATENT DOCUMENTS

| | | | | |
|---|---|---|---|---|
| 7,059,890 | B2 * | 6/2006 | Donhauser | 439/409 |
| 7,344,404 | B2 * | 3/2008 | Wilinski | 439/409 |
| 7,462,060 | B2 * | 12/2008 | Hamoignon | 439/409 |
| 2004/0029431 | A1 | 2/2004 | Comini | |

FOREIGN PATENT DOCUMENTS

| | | |
|---|---|---|
| WO | WO 9904454 | 1/1999 |
| WO | WO 9904455 | 1/1999 |

OTHER PUBLICATIONS

Witten Opinion of International Search Report for PCT/EP2006/0084950, EPO, Feb. 28, 2008.

* cited by examiner

CLAMPING DEVICE FOR CONNECTING A CONDUCTOR WITHOUT STRIPPING THE INSULATION

CROSS-REFERENCE TO RELATED APPLICATIONS

This application claims priority from PCT Application PCT/EP2006/008495 filed on Aug. 29, 2006 entitled "Clamping Device For Connecting A Conductor Without Stripping The Insulation" and PCT Application PCT/EP2006/008327 filed on Aug. 25, 2006 and U.S. Provisional Patent Application No. 60/712,210 filed on Aug. 29, 2005, all of which are incorporated fully herein by reference.

TECHNICAL FIELD

The invention relates to a clamping device for a connector for connecting a conductor to the connector without first having to strip insulation from the wire

BACKGROUND INFORMATION

The invention starts from a clamping device as is known from patent document DE 199 56 750 A1. The known clamping device possesses a housing and an actuating part mounted so that it may move between a receiver position and a contact position. This actuating part possesses a duct for the conductor to be clamped. Further, a blade contact is present that consists of a rear web and two spring legs at an angle to the longitudinal side and at a distance from each other. These spring legs possess end sections bent toward each other that are adjacent along a slot and possess contact blades on their face edges that extend toward the slot. When the actuating part is pivoted into the contact position, the contact blades press into the duct of the actuating part and contact the conductor received therein, cutting through its insulation. A second contact part is provided for subsequent routing of the current path from the blade contact out of the housing that is in electrical contact with the blade contact. In the known implementation, the second contact is implemented as a separately-manufactured contact pin that is combined with the blade contact into a single component. The manufacture of this component is expensive because the pin contact must be secured to the rear web of the blade contact by means of soldering, welding, riveting, or pressing. Such joined contact points also include the uncertainty that contact security may be influenced by corrosive, thermal, or mechanical effects.

A clamping device with similar structure is known from prototype document DE 203 12 123 U1. The actuating part of this clamp is mounted within the clamp housing between the receiver position and the contact position so that it may pivot, whereby the insulated conductor accepted into the duct of the actuating part is inserted between the contact blades of the blade contact upon pivoting the actuating part into the contact position. The current path within the clamp is continued via a current rail that is inserted with electrical connection into the rear web of the blade contact.

Patent document DE 2 129 630 A further discloses a clamping device of the above-mentioned type. Here, cutting, clamping contacts are provided that interact with two different actuating parts that are mounted so that they may pivot and that are in the form of flat cutters, and that are connected together by means of a web. They project from this web along the same direction, whereby another contact is mounted at an angle along the opposite direction.

Patent document US 2004/0029431 A1 discloses a clamping device in another embodiment with one-piece contact parts that include blade contacts at their one ends that are displaced by 90° with respect to each other, and plug connectors at their other ends.

SUMMARY

The task of the invention is to provide a clamping device for connecting a conductor without stripping its insulation in which the blade contact and the second contact leading away from the clamp are manufactured to provide positive electrical contact and to provide a strong embodiment in a particularly efficient manner.

One feature of the invention is that the blade contact and the second electrical contact leading out of the clamping device from the clamp are of one piece in that they are formed on a contact element that possesses a rear web common to both contacts. After the first production step, the metallic contact element consists of a flat pressed part with spring legs and spring arms cut apart from each other and connected to the rear web. In subsequent production steps, the contact blades are formed on the spring legs, and the tube shapes are formed on the spring arms, and the spring legs and arms are bent into their position at an angle to the rear web.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENTS

Figure 1:
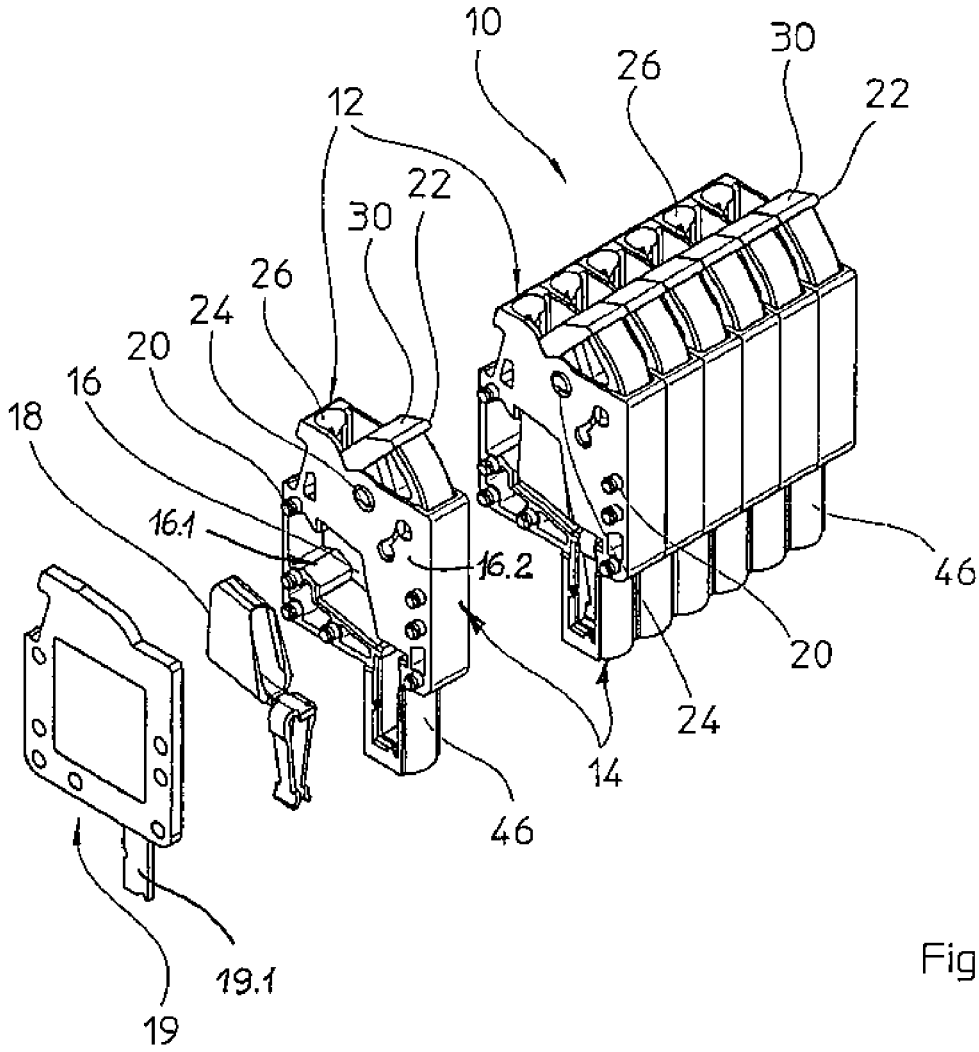
FIG. 1 is a perspective, partially exploded view of a clamp arrangement consisting of several clamping devices.

FIG. 1 shows individually the clamp arrangement 10 formed from a number of identical modules 12. Each of the modules 12 represents a clamping device that includes a housing 14. The interior of the housing 14 includes a specially-shaped inner chamber 16 that is open on one side of the housing 14 in that an aperture 16.1 is formed by means of a contoured recess in the pertinent housing sidewall 16.2. The special configuration of the aperture 16.1 and of the inner chamber 16 serves for the reception of a contact element 18 that will be described in greater detail using FIG. 2 herein.

Engaging pegs 20 project laterally from the housing 14 that is made of insulating material. These engaging pegs 20 are located on that side of the housing 14 in which the housing aperture 16.1 is provided. On the opposing side (not shown), the housing 14 is closed, and on this side are located engaging apertures arranged to match the engaging pegs 20. Two or more of the modules 12 are correspondingly capable of being matched and engaged together, and thus the clamp arrangement 10 may be formed by placing the modules 12 adjacent to one another. For this, the closed sidewall of the housing 14 of each module 12 covers the housing aperture 16.1 of the adjacent module 12. A cover 19 is provided for the module positioned at the end of the series whose housing aperture 16 in the housing 14 is not covered by a neighboring module in order to be able to close the aperture 16.1.

An actuating part 22 is mounted within the interior of the housing 14 of each module 12 or of each clamping device so that it may pivot. The actuating part 22 serves to receive the electrical conductor to which contact is to be provided. During conductor insertion, [the actuating part 22] is positioned in its first pivoted position in receiving mode, and can be transferred to its second pivoted (contact) position by means of suitable actuation. For this, the actuating part 22 rotates by means of axial pegs 24 within bearing apertures that are located in the upper areas of the housing sidewall 16.2. The actuating part 22 is provided with a duct or opening 26 to receive the conductor 50 (FIG. 4) to which contact is to be provided. This duct 26 includes an insertion aperture on the upper side of the module 12. Further, a plug insertion aperture for an actuation tool is formed in the actuating part 22 that is also accessible from the upper side of the module 12. Further, a surface 30 for pressing is located on the upper side of the actuating part 22.

Figure 2:
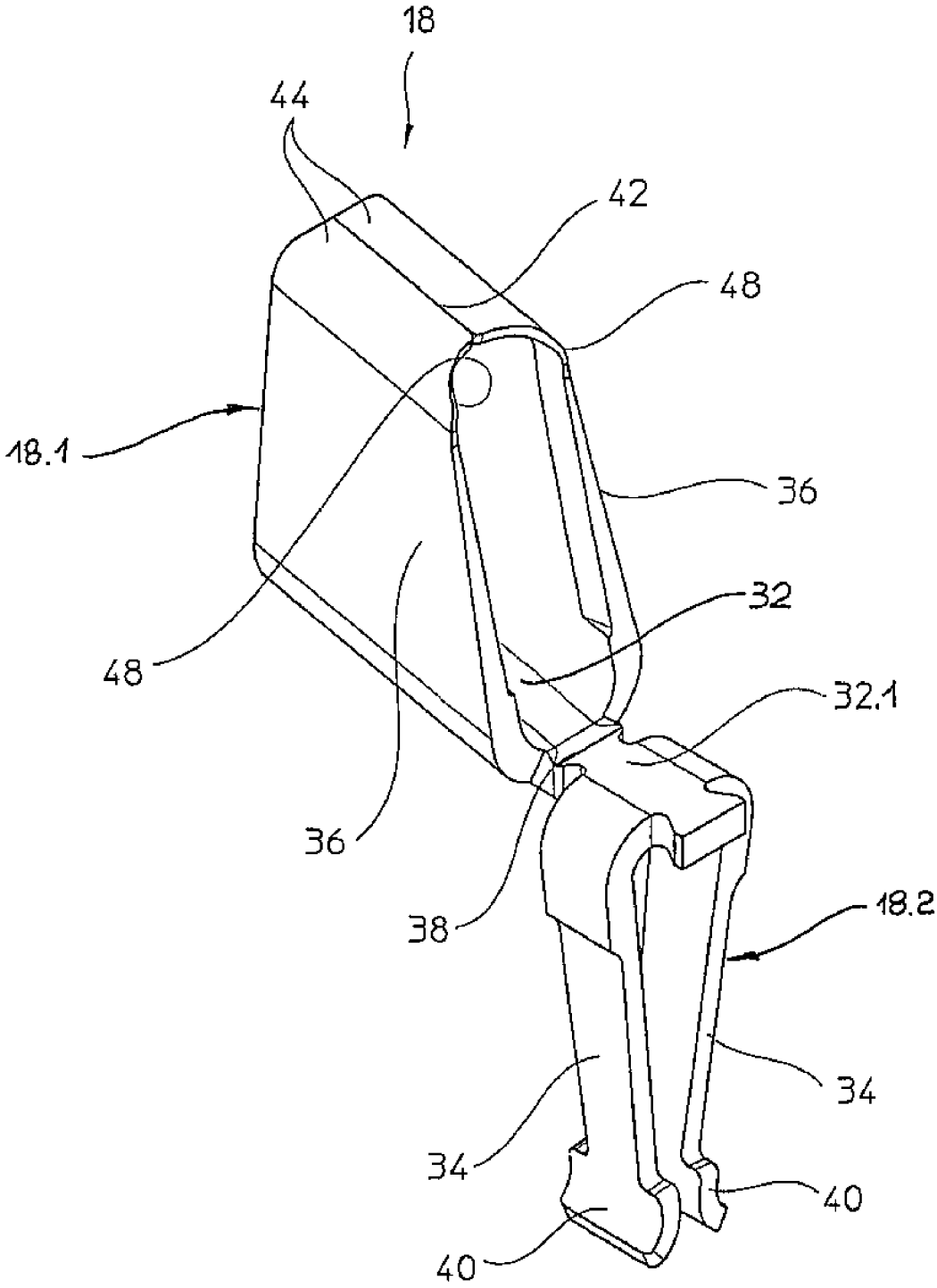
FIG. 2 is a perspective depiction of the contact elements of each of the clamping devices forming the current path as in FIG. 1.

As FIG. 2 shows, the contact element 18 is free-stamped out of a metal plate such as steel plate into a component formed as one piece, and is then shaped (bent) to provide its final shape. The contact element 18 consists of a blade contact 18.1 and of a second contact part 18.2. The central connection piece of the blade contact 18.1 and of the second contact part 18.2 is a rear web 32 that includes an elongated section 32.1 extending above the area of the blade contact 18.1 and assigned to the second contact 18.2. A spring leg 36 is attached to the longitudinal sides of the rear web 32 in the area of the blade contact 18.2 and is bent upward and whose cross section diminishes along the direction of the rear web 32. Particularly, the thickness of the spring leg 36 diminishes. Contact blades 48 are formed in the area of the upper edges of the spring leg 36 that extend along the face edges of end sections 44 on the spring legs 36, whereby these end sections 36 are bent down and are adjacent to one another along a slot 42. The rear web 32 is bent upward slightly with respect to the peg section 32.1 at the transition point 38 between the rear web 32 and this peg section 32.1 adjacent to it in order to bring the spring leg 36 with its contact blades 48 into a favorable position for establishing contact with the pertinent conductor 50. The contact blades 48 are located on that face side of the blade contact 18.1 that lies toward the peg section 32.1.

Spring arms 34 extend at a downward angle to the longitudinal sides of the peg section 32.1 in opposing directions to the spring legs 36 of the blade contact 18.1. These spring arms 34 converge toward one another along the direction away from the peg section 32.1, and their free ends are shaped into a contact tube or tulip contact. The spring arms 34 also diminish in cross section along the direction away from the peg section 32.1, and they particularly diminish in thickness along this direction. The contact tube or tulip contact formed from the spring arms 34 serves to provide contact with a contact pin 41 (FIG. 3) that is mounted on a base element such as a printed circuit board.

The spring arms 34 of the second contact may also be angled along a direction to the rear web 32 or to its peg section 32.1 different than that shown, along the same direction as the spring leg 36 of the blade contact 18.1. For this, the spring arms 34 of the second contact 18.2 leave a gap to the spring legs 36 of the blade contact 18.1. In order to be able to insert the conductor 50 with which contact is to be established into contact blades 48 of the spring leg 36 of the blade contact 18.1, one aligns the contact blades 48 to those edges of the spring leg 36 of the blade contact 18.1 that rest to the side of the blade contact 18.1 that is adjacent to the second contact 18.1.

The spring legs 36 of the blade contact 18.1 are designed stronger then the spring legs 34 of the second contact part 18.2. Thus, the spring legs 36 extend longitudinally as seen from the rear web 32 over a greater length than do the spring arms 34 of the second contact part 18.2. The end sections 44 bent toward one another at the spring legs 36 may be separated from each other in the area of the slot 42. The spring legs 36 of the blade contact 18.1 may be so tensioned that the end sections 44 in the area of the slot 42 may rest against one another under spring pressure, which serves to an increase of the contact pressure against a clamped conductor. The contact blades 48 on the face edges of the spring leg 36 in the area of its end sections 44 are shaped concave, and extend as far as the slot 42.

Figure 3:
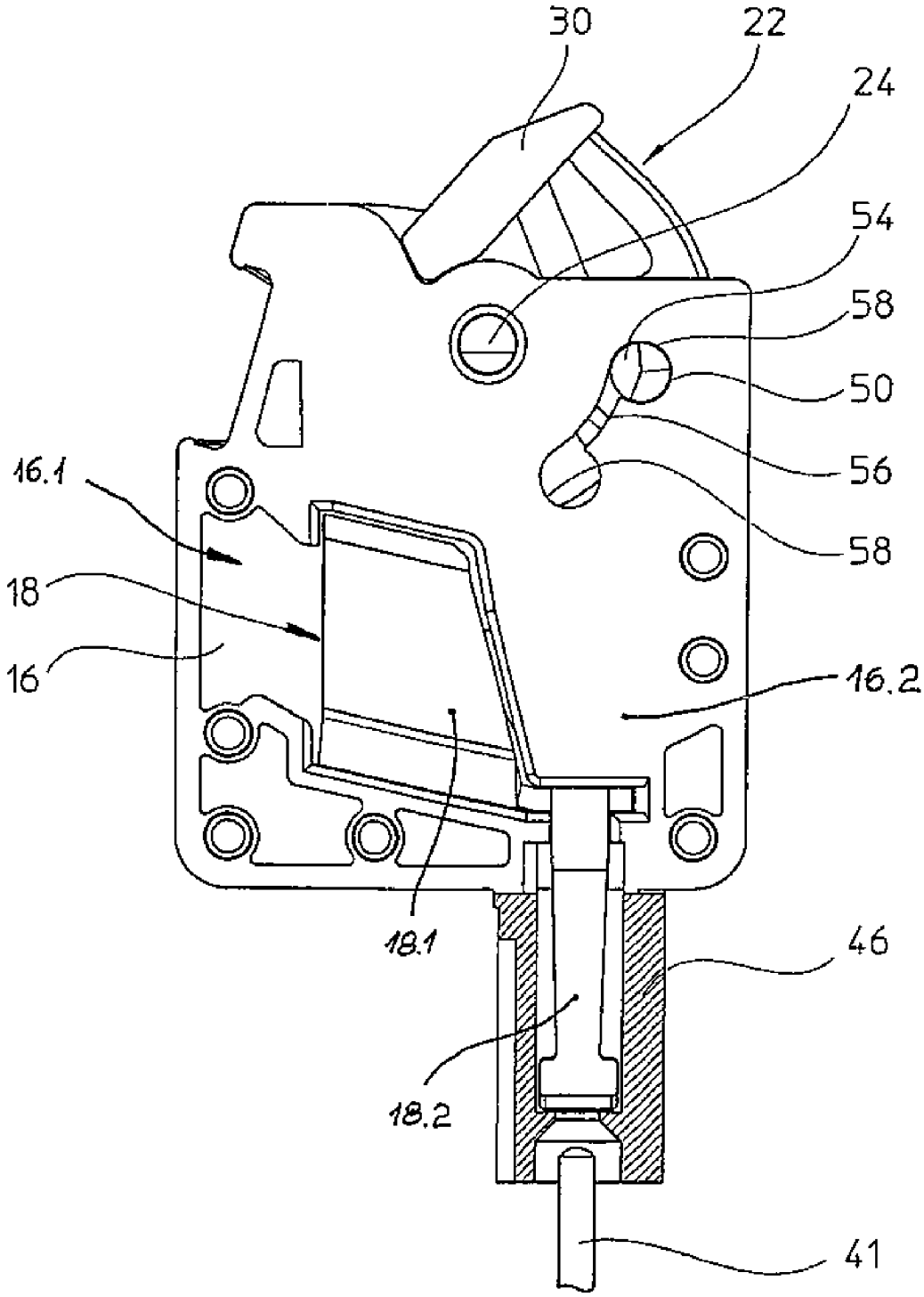
FIG. 3 is a lateral view of one of the clamping devices.

As may be seen in FIGS. 1 and 3, the housing 14 of the modules 12 possesses a box-shaped upper part 14.1 to which a hollow base part 46 of the housing 14 is attached from below. The inner chamber 16 within the housing and the aperture 16.1 in the pertinent sidewall 16.2 of the housing 14 extend from the upper housing part 14.1 into the housing base part 46. Thus, the contact element 18 in its installed position with the spring legs 36 of its blade contact 18.1 and with the spring arms 34 of its second contact part 18.2 are fit into the inner chamber 16 of the housing 14 in that the blade contact 18.1 is received within the housing upper part 14.1 and the second contact 18.2 is received within the housing base part 46. During this, the blade contact 18.1 is located below the actuating part 22 formed as a pressing surface. The cover part 19 is thus matched to the special contour of the aperture 16.1 such that a continuation 19.1 is formed underneath that covers the portion of the aperture above the base part 46.

Figure 4:
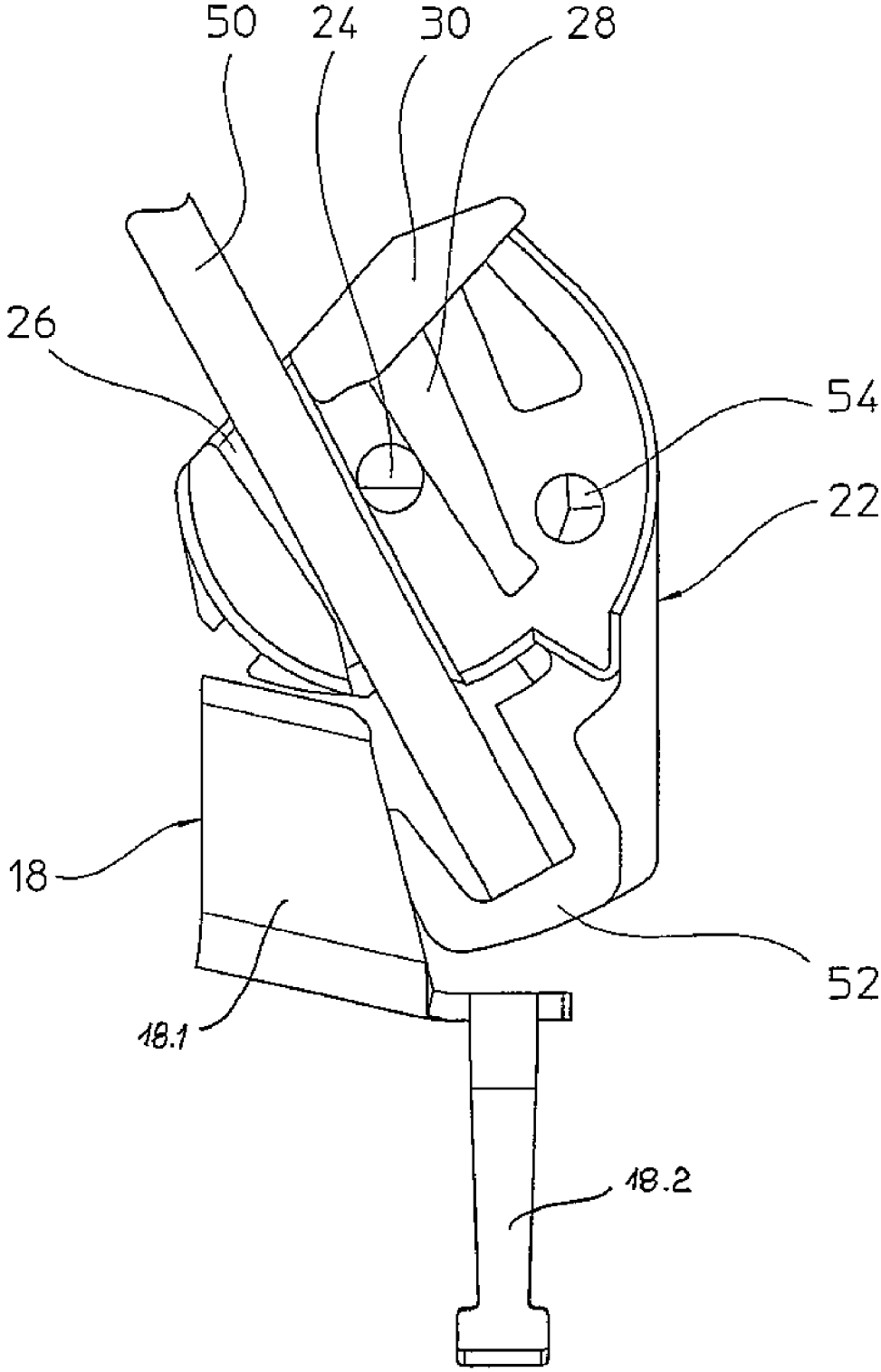
FIG. 4 is a lateral view of the contact elements of the clamping devices and the actuating part interacting with it in its receiver position.
Figure 5:
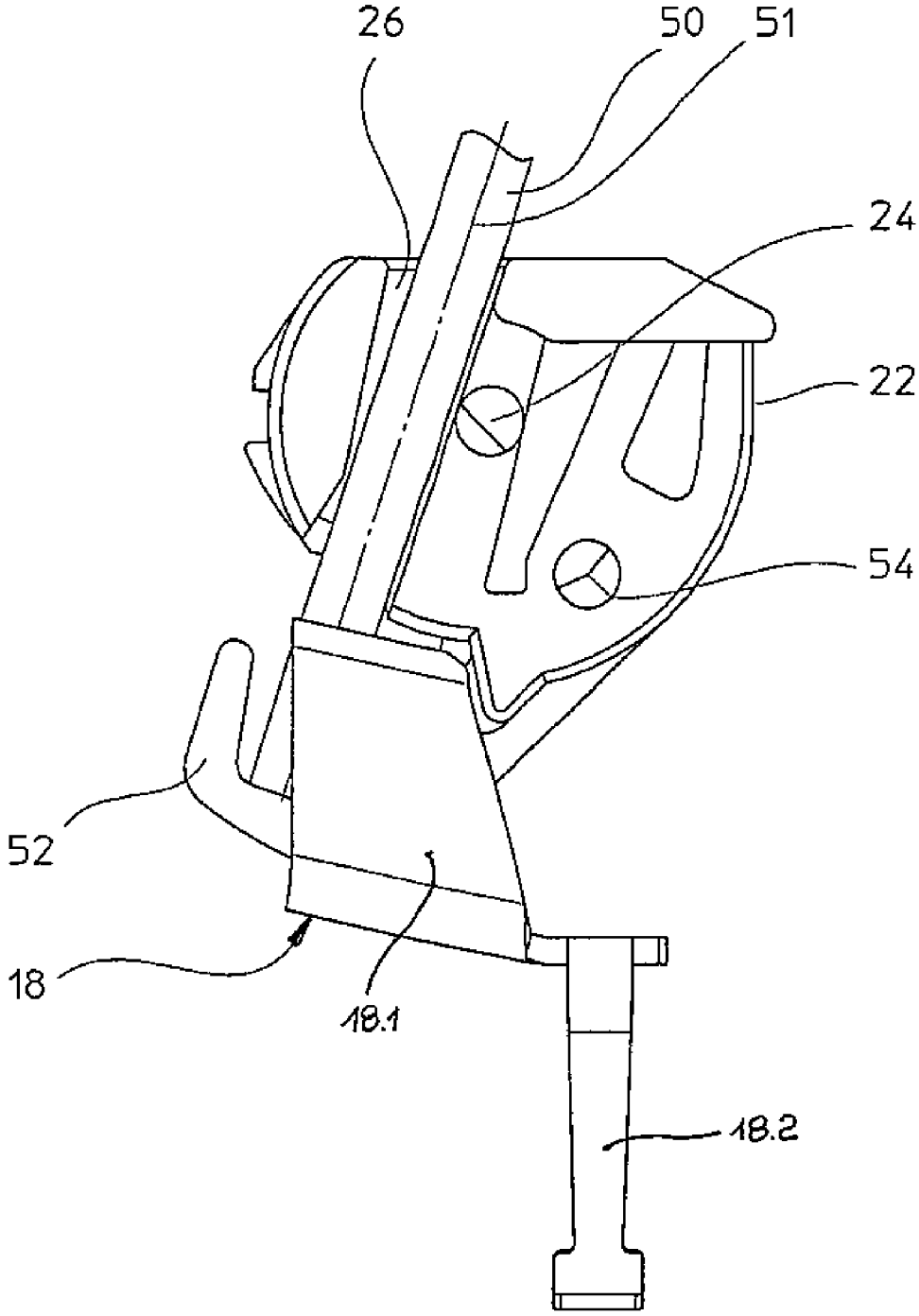
FIG. 5 is a representation corresponding to FIG. 4 with the actuating part located in the contact position.

Contact with the conductor with which contact is to be established upon separation of the conductor insulation may be seen in FIGS. 4 and 5. FIG. 4 shows one of the modules 12 or of the clamping devices in the conductor-insertion position. The actuating part 22 is thus rotated upward counterclockwise so that the surface 30 for pressing is located above the housing. The conductor 50 is inserted into the receiver duct 26 of the actuating part 22 to the point that its end rests against a stop 52. The conductor 50 may include a one-part core or twisted metal core of individual wires. After the conductor 50 is inserted into the duct 26 of the actuating part 22, a long tool is inserted into its insertion aperture and/or the surface 30 is pressed and thus the actuating part 22 is rotated clockwise from its wire-insertion position into its contact position, as shown in FIG. 5. In the contact position of the actuating part 22, its surface 30 lies against the upper side of the housing 14.

When the actuating part 22 with the inserted conductor is pivoted into the contact position, the conductor comes into contact with the contact blades 48 of the blade contact 18.1. The contact blades 48 cut through the insulation of the conductor 50 in order to expose the conductor core. While the conductor core 51 is forced into the slot 42 between the end sections 44 of the spring leg 36, the spring leg 36 is expanded outward, and reliable electrical contact between the blade contact 18.1 and the conductor core 51 because of the spring tension.

In order to remove the conductor 50 from the module 12, a long tool is again inserted into the insertion aperture 28 of the actuating part 22, and the actuating part 22 is pivoted counterclockwise away from the contact position into the insertion position, whereby the conductor 50 is released from the spring legs 36 of the blade contact 18.1. The conductor 50 may then be extracted from the conductor receiver duct 26 of the actuating part 22.

The pivotable pressing part 22 includes an engagement notch 54. During pivoting of the pressing part 22 between the conductor-receiving position and the contact position, the engaging notch 54 slides into a slot 56 in one of the housing sidewalls 16.2, whereby it engages with the pivoting end positions into a circularly-formed end of the slot 56.

When the clamp arrangement 10 is used as a plug element, the conductors 50 are first clamped to the individual modules 12, and then the clamp arrangement 10 is positioned onto a corresponding number of contact pins 41 that are mounted on the base component of each circuit. Subsequently, these pins 41 are electrically connected with conductors 50 or their conductor cores by means of the contact elements 18.

The present invention is not intended to be limited to a device or method which must satisfy one or more of any stated or implied objects or features of the invention and should not be limited to the preferred, exemplary, or primary embodiment(s) described herein. Modifications and substitutions by one of ordinary skill in the art are considered to be within the scope of the present invention, which is not to be limited except by the allowed claims and their legal equivalents.

The invention claimed is:

1. A clamping device for connecting a conductor (50) without stripping its insulation, the clamping device having a housing (14) and an actuating part (22) mounted to pivot between a receiver position and a contact position, the housing including a duct (26) to receive the conductor (50) with which contact is to be established, and also a blade contact (18.1) that includes a rear web (32) and two spring legs (36) with end sections (44) bent toward each other that are adjacent to each other along a slot (42) and include contact blades (48) extending to the slot (42) which, when the actuating part (22) is transferred into the contact position, presses into its duct (26) and comes into contact with the conductor (50) contained within it after cutting through its insulation, and with a second contact part (18.2) to route the current path from the blade contact (18.1) out of the housing (14), which is in electrical contact with the blade contact (18.1), whereby the blade contact (18.1) and the second contact part (18.2) are formed as a single unit and whereby the rear web (32) of the blade contact (18.1) possesses a section (32.1) that is elongated over connection areas of the spring leg (36) from whose longitudinal sides spring arms (34) are bent that together with their ends are shaped into a contact tube or tulip contact (40).

2. A clamping device as in claim 1, wherein when viewed longitudinally along the rear web (32), the spring legs (36) of the blade contact (18.1) are wider than the spring arms (34) of the second contact part (18.2), and their cross section diminishes from the rear web (32) toward the contact blades (48).

3. A clamping device as in claim 1, wherein the spring arms (34) of the second contact part (18.2) possess a cross section that diminishes from the rear web (32) to a contact tube or tulip contact (40).

4. A clamping device as in claim 1, wherein the spring arms (34) of the second contact part (18.2) are angled from the rear web (32) in the direction opposite to the spring legs (36) of the blade contact (18.1).

5. A clamping device as in claim 4, wherein the contact blades (48) are located on those edges of the spring leg (36) of the blade contact (18.1) that lie to the side of the web section (32.1) and of the thus-formed second contact (18.2).

6. A clamping device as in claim 5, wherein the rear web (32) and the web section (32.1) of the contact element (18) are at an obtuse angle to each other.

7. A clamping device as in claim 1, wherein the spring arms (34) of the second contact part (18.2) are angled in the same direction as the spring legs (36) of the blade contact (18.1) from the rear web (32), whereby the contact blades (48) are located on those edges of the spring legs (36) of the blade contact (18.1) that rest at the side of the blade contact (18.1) adjacent to which the spring arms (34) of the second contact part (18.2) are located.

8. A clamping device as in claim 1, wherein the housing (14) includes an inner chamber (16) and an aperture (16.1) in its one sidewall (16.2) to receive the contact elements (18), whereby the inner chamber (16) and the aperture (16.1) are matched to the contour of the contact element (18) surrounding both ends of the rear web (32).

9. A clamping device as in claim 8, wherein the housing (14) possesses an upper part (14.1) with a flat box shape, and the actuating part (22) and the blade contact (18.1) are mounted within it, to which a hollow base part (46) on the underside of the upper housing part (14.1) is adjacent, in which the second contact part (18.2) is received and correspondingly the inner chamber (16) and the aperture (16.1) of the housing extend from the upper housing part (14.1) into the base part (46).

10. A clamping device as in claim 8, wherein the clamping device is implemented as a module (12) and accordingly its housing (14) includes equally covering sidewalls (16.2) to be placed in series of two or more such modules (12), whereby when placed in sequential series the aperture of the pertinent sidewall (16.2) of the one module (12) is at least partially covered and closes the aperture (16.1) with the sidewall of an adjacent module (12) located at the end of the series as a cover part (19), which possesses the contour of the upper housing part (14.1) and on its underside, a continuation (19.1) enclosing the aperture area of the housing base part (46) is formed.

* * * * *